US005203643A

United States Patent [19]

Mork

[11] Patent Number: 5,203,643

[45] Date of Patent: Apr. 20, 1993

[54] METHOD AND APPARATUS FOR ADAPTIVE ICE CONTROL

[76] Inventor: Raymond P. Mork, HC69 Sewall Rd., Wolfeboro, N.H. 03894

[21] Appl. No.: 881,144

[22] Filed: May 11, 1992

[51] Int. Cl.[5] ..... E02B 15/02

[52] U.S. Cl. ..... 405/61; 405/62

[58] Field of Search ..... 405/52, 60, 61, 62, 405/80, 118

[56] References Cited

U.S. PATENT DOCUMENTS

| | | | |
|---|---|---|---|
| 3,109,288 | 11/1963 | Gross | 405/61 |
| 4,247,261 | 1/1981 | Springtson | 417/44 |
| 4,279,537 | 7/1981 | Tweedy | 405/61 |
| 4,666,335 | 5/1987 | Jones | 405/61 |
| 5,017,093 | 5/1991 | Naes | 405/61 X |

*Primary Examiner*—David H. Corbin
*Attorney, Agent, or Firm*—Lahive & Cockfield

[57] ABSTRACT

A method and controls for cyclical operation of ice reducers in open bodies of water. An ambient condition transducer provides an ambient signal representing the amplitude of a condition affecting ice formation. A timer cyclically produces a ramp signal, thereby setting the frequency of cycles for operation of a water movement device. In each cycle a comparator compares the relative amplitudes represented by the ambient and ramp signals and gates power to said device upon a change in the sign of the difference between said amplitudes. Thus the duration of gated power in each cycle is a function of the ambient condition.

24 Claims, 2 Drawing Sheets

METHOD AND APPARATUS FOR ADAPTIVE ICE CONTROL

BRIEF SUMMARY OF THE INVENTION

This invention relates generally to methods and controls for operation of ice reducers to clear or prevent ice formations in surface areas of open bodies of water, for the protection of docks, piers, boats, shores and other structures from damage by ice. More particularly, the invention relates to means for cyclically controlling the application of power to such devices.

The controls of this invention are useful with any of a wide variety of known energy transducers located and adapted to produce water movements beneath the areas where surface ice is to be reduced, prevented or eliminated. The two principal types of devices for such purpose are "bubblers" and "circulators", also commonly referred to as "deicers" or "agitators".

A bubbler comprises an underwater, weighted hose having small perforations and means to apply compressed air to the hose, thereby producing streams of small bubbles that keep the surface water above the hose moving and preventing it from freezing.

A circulator may comprise a small underwater propeller driven by an electric motor to move warmer water upwardly and outwardly with some velocity to prevent freezing or to melt surface ice and prevent further freezing. Examples are described in U.S. Pat. No. 4,247,261 to Springston and U.S. Pat. No. 5,017,093 to Naes. A circulator may also comprise water conduits connected with a submersible pump as described in U.S. Pat. No. 4,666,335 to Jones.

For simplicity of controls the above-described devices are of the on-off type, rather than of variable speed. In operation, they are effective to reduce or eliminate ice formations, but present a number of serious problems when employed with the controls presently in use.

In general, the objects of this invention are to eliminate these problems, among which are the inability to control properly the desired local area to be cleared, the production of noise, the necessity for frequent or expensive maintenance, the high cost of equipment and the consumption of excessive and expensive power. A number of conditions affect ice formations, including the air temperature, the water temperature, the wind velocity, wave action, humidity and sunlight intensity. These conditions change constantly, but typical ice controls in present use do not take prompt and appropriate account of their effect on ice formation.

Ideally, ice should be eliminated from only an area of an open body of water that is localized around the object or objects to be protected from damage by ice. If ice is eliminated or weakened over a substantial length of the shoreline, wind and water currents are allowed to move the main ice mass of the body in against the shore, thereby causing damage to docks, vessels moored to the docks, and other shore installations. Commonly, circulators installed at closely-spaced intervals along a shore may thus keep the whole shore open, exposing it to this hazard. An open shore also prevents access to the ice for sports and transportation.

Bubbles are effective to protect desired local areas, but the air compressors are noisy and the systems require considerable maintenance and must usually be run continuously to prevent freezing in the hose near the surface of the water circulators require little maintenance and are capable of keeping large areas open, but they require considerable power and are expensive to operate if run continuously. The Springston patent describes an electric motor rated at one-third horsepower, and other typical motors are rated at one-half horsepower or more.

The Springston patent describes control means responsive to the air temperature above the water surface to actuate the motor of a circulator-type water pumping device, allowing it to be run only when the ambient air temperature is below a predetermined value. This primitive arrangement saves some power but does not address the problem of controlling the size of the area to be cleared of ice. This patent also describes a timer which may be used to actuate the motor at predetermined times. To be effective, the time cycle must be reset frequently as weather conditions vary from day to day. This is frequently difficult or impossible when there is no attendant available to make necessary adjustments over an extended period of time. Furthermore, if the circulator is off for more than a few hours, under certain freezing conditions ice an inch thick or more may form, and in this case the circulator may require an hour or more to melt even a small hole in the surface ice. The circulator may then force a large amount of water through the hole onto the ice surface. The weight of this water may then cause the ice to sink, and the water on top to spread out for some distance, compounding the problem and requiring more time to open the area.

An object of this invention is provide controls which continually sense one or more of the above-mentioned ambient ice-forming conditions and control the power to ice-reducing devices.

Another object is to reduce the energy required, and consequently the cost for operation of such devices.

Another object is to provide optimum automatic, unattended control of such devices.

Another object is provide full protection of docks, piers, boats and other objects or installations within any selected area of an open body of water, without removing the ice in adjoining areas. This will protect the shore by allowing ice formation in adjoining areas, thereby preventing or reducing the movement of the general ice mass, and will also provide access to the ice in such adjoining areas.

An additional object is to eliminate ice at frequent intervals of time while the ice is very thin and easily broken.

Another object is to provide control of ice-reducing devices by any one or a combination of the ambient ice-formation conditions.

With the foregoing and other objects in view, this invention employs a method and controls adapted to operate any desired ice-reducing device or devices frequently and intermittently in cycles, the duration of operation in each cycle being dependent on the freezing conditions.

Another feature is that these conditions may control either the duration of power delivery to the ice-reducing device in each cycle, or the frequency of the cycles, or both, whereby the duration of power delivery per unit of time (the "duty cycle") is a function of one or more ambient conditions.

Another feature is the employment, in an ice-reducing control, of a timer for cyclically producing a ramp signal, an ambient condition transducer producing an ambient signal, and a comparator for comparing the amplitudes represented by these signals, and adapted to control the duty cycle as a function of the comparison.

Another feature permits the invention to be implemented by a variety of means including either mechanical or electrical embodiments, or a combination of such embodiments.

Other features of the invention will be evident from the following description.

DETAILED DESCRIPTION

Figure 1:
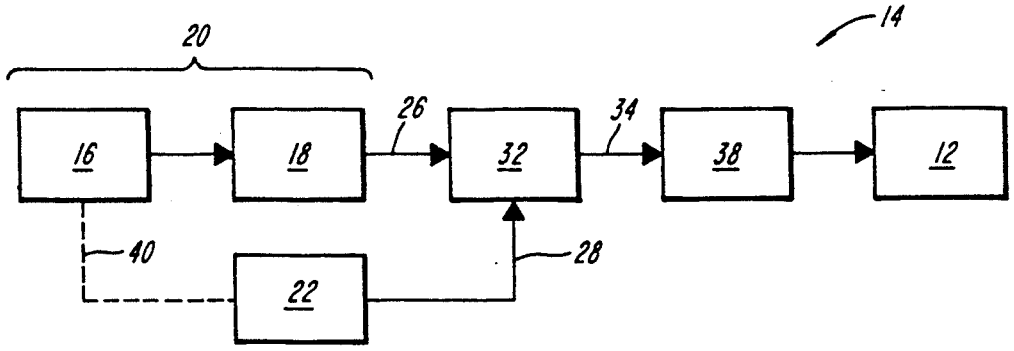
FIG. 1 is a block diagram illustrating the components of the invention in generalized form.
Figure 2:
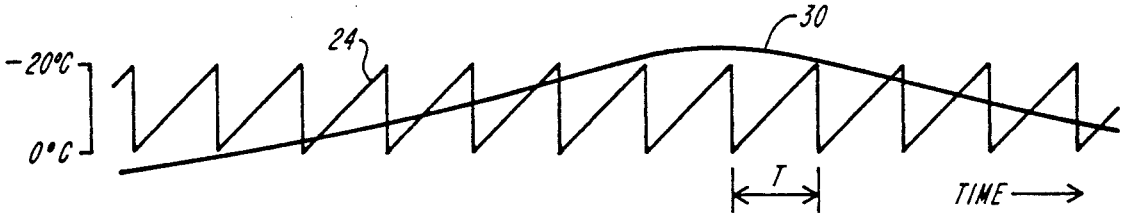
FIG. 2 is a time diagram of the ambient signal produced by the ambient condition transducer and the ramp signal produced by the timer.
Figure 3:
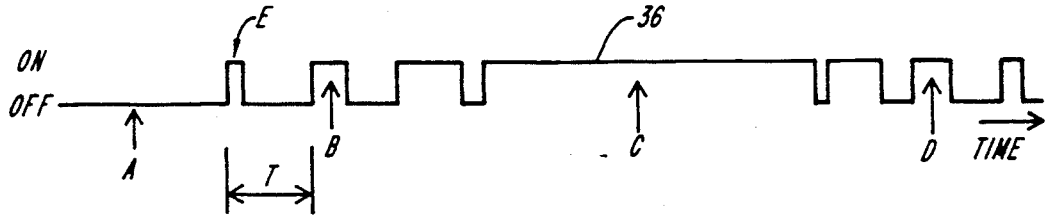
FIG. 3 corresponds to FIG. 2 and is a time diagram of the signal output from the comparator, such signal output controlling the connection of the ice reducing transducer to its source of energy.

FIGS. 1-3 illustrate the principal components and operation of the invention in generalized form. Referring to FIG. 1, 12 represents an ice-reducing device, which is an energy transducer located and adapted to produce water movements beneath an area of water to be kept clear of ice. The device 12 may take the form of a bubbler or any of the forms of circulators referred to above or otherwise known in the art. The remaining elements in FIG. 1 comprise a control 14 for switching or gating energy to the device 12.

An element 16 comprises a timing source having a cyclical output. The source 16 may produce the cycles of fixed or variable frequency in the form of either electrical pulses or reciprocal mechanical movements, typically rotations, of an output device. The source may derive the frequency of the cycles from an available power frequency, or from an internal oscillator or a synchronous or asynchronous motor.

An element 18 comprises means for producing a ramp signal having in each cycle produced by the device 16 a characteristic representing, in either digital or analog form, an amplitude that increases progressively between minimum and maximum values. In one form such characteristic is the amplitude of either an electrical signal or the displacement of a mechanical part. The combined elements 16 and 18 comprise a timer 20 for cyclically producing the ramp signal.

An element 22 comprises an ambient condition transducer for sensing a condition that affects ice formation and producing an ambient signal in digital or analog form representing its amplitude. Of the various ambient conditions affecting ice formation the air temperature is the most significant, and in a typical simplified embodiment this element is an air temperature sensor in the form of either a thermal transducer or a component of a thermostat.

A cyclical sawtooth waveform 24 illustrates an analog ramp signal in FIG. 2, and appears on a line 26. An analog ambient signal from the transducer 22 appears on a line 28, and an illustrative waveform showing that signal is shown at 30 in FIG. 2. As shown in FIG. 2, the ramp signal has a period T. As discussed below, embodiments may be constructed in which the period T is variable as a function of one or a combination of ice-forming conditions. Thus, the timing source 16 may be adapted to produce cycles of either fixed or variable frequency.

A comparator 32 is adapted to compare the amplitudes represented by the ambient and ramp signals and to produce on a line 34 a signal 36 (FIG. 3) which changes upon a change in the sign of the difference between these amplitudes. The signal 36 changes between two levels and thus has an on-off form as illustrated. The signal 36 is off when the ramp characteristic exceeds the ambient characteristic, and on when the ambient characteristic exceeds the ramp characteristic. Thus, in each cycle, the duration of the on condition is the fraction of the cycle during which the ambient characteristic has a greater amplitude than the ramp characteristic, and such duration increases as the ambient characteristic increases as shown in FIG. 2. According to this invention, such increase represents an increasing tendency to form ice, such as a decrease in the ambient air temperature, or a corresponding change in any other ambient condition sensed by the transducer 22 which increases the rate of ice formation.

As described above the comparator 32 measures the difference between analog representations of the ambient and ramp signals. As an alternative, those signals may take digital form, in which case the comparator computes the difference between the digital values and responds to a change in the sign of the computed difference.

The on-off signal 36 operates a switch or gate 38, which may be a relay or other device for connecting a source of power to the ice reducing device or devices 12.

Assuming that the transducer 22 senses ambient air temperature, it will be evident from the foregoing description that power is delivered to the device 12 over an increasing time duration in each cycle with an increasing drop in the ambient air temperature, thus supplying increasingly long periods of water movement to reduce ice formation. For purposes of illustration, assume that the period T is one hour and that the ramp characteristic is adapted to vary in amplitude between minimum and maximum values which, if produced by the transducer 22, would represent 0° C. to −20° C. A non-freezing condition is represented at A in FIG. 3 and the device 12 is off. With increasing freezing the device remains on for increasing periods as shown at B. At temperatures lower than −20° C. the device remains on throughout each cycle, that is, it remains on continuously as shown at C. As the ambient air temperature increases above −20° C. the device 12 returns to a cyclical on-off mode with progressively shorter on periods in successive cycles.

In the ramp generator, provision is made for adjusting the amplitude of its output in order to allow setting the size of the area to be protected. A larger amplitude will shorten the time the device is on in each cycle and reduce the size of the area cleared.

For purposes of illustration, FIG. 2 shows rapidly changing ambient temperature over a wide range. In most installations, continuous operation as shown at C would not be required, and the ramp characteristic would be adjusted for a greater amplitude than that shown. In that case the average duty cycle of device operation would be very low, resulting in a substantial savings in power.

Referring to FIG. 1, a broken line 40 represents an optional arrangement in which the temperature or other ambient condition transducer 22 is connected to the timing control 16, such control in this case comprising a variable frequency oscillator. By this connection, if the ambient condition transducer 22 is an air temperature sensor, as the air temperature decreases a signal on the line 40 increases the frequency of the oscillator timing device 16. Conversely, a reduction in the frequency is produced upon an increase in the ambient air temperature. The decrease in the frequency of operation of the device 12 under milder conditions also results in a saving of power consumption.

The period T of typical operation is sufficiently short to enable the control to commence operation soon after ice begins to form and is very thin and easily broken. Under such conditions the device 12 is on for only a brief portion of each cycle as at E in FIG. 3, and thus, power consumption is low and the problems inherent in attempting the elimination of thick layers of ice are avoided.

Figure 4:
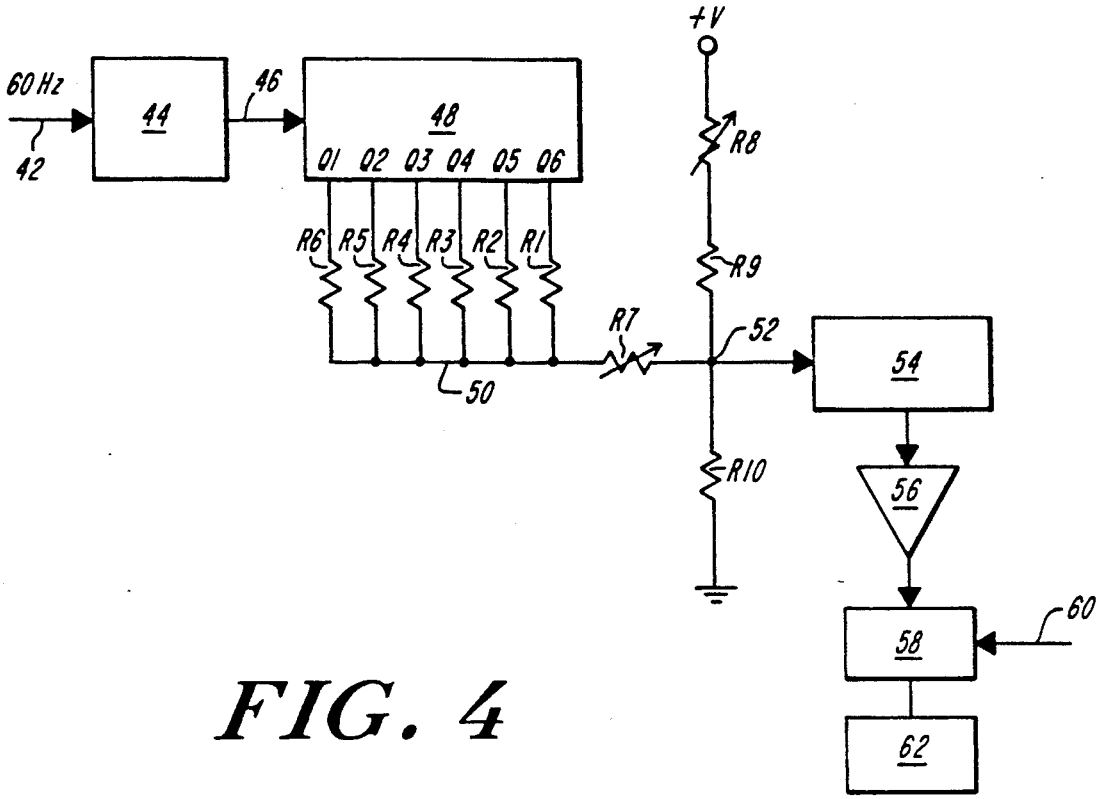
FIG. 4 is a schematic diagram of the presently preferred embodiment of the invention employing electronic components.

FIG. 4 shows a preferred embodiment of the invention using electronic components. In this embodiment an a-c line voltage is used as the timing source 16 and such voltage is connected by a line 42 to a counter 44. The counter 44 is a 12-bit binary counter with appropriate feedback to divide the input frequency by 3375, and may be, for example, a CMOS type 4040 integrated circuit. The circuit 44 produces pulses on a line 46 at a frequency of 8 per hour.

These pulses are applied to a 6-bit binary counter 48 which may be, for example, a CMOS type 4024 integrated circuit. Connections Q1–Q6 represent the output stages of this counter, and are respectively connected by resistors R6 to R1 to a common line 50. The line 50 is connected through a resistor R7 to a network comprising resistors R8, R9 and R10, which is connected to a fixed d-c voltage source V. The values of the resistors R1 to R6 progress in resistance value so that the voltage at a junction 52 progresses in a stairstep manner over a period of one hour, thus approximating the configuration of the waveform 24 in FIG. 2 and comprising an electrical voltage analog of the ramp characteristic. The value of the resistor R2 is twice that of the resistor R1, the value of the resistor R3 is twice that of the resistor R2, etc. Although the waveform is not as smooth as the waveform 24, the steps which occur at equal time intervals are small, and no significant effect on the performance of the control occurs.

The junction 52 is connected to a unit 54 which corresponds in function to the ambient condition transducer 22 and comparator 32 of FIG. 1. The resistance network provides the attenuation and biasing required by the unit 54, the resistor R7 providing adjustment of the ramp voltage and the size of the area to be kept free of ice, and the resistor R8 providing the setting of the temperature at which ice protection is needed (i.e., 0° C.). The unit 54 may comprise a single integrated circuit, for example, a National Semiconductor type LM3911, which consists of a temperature sensor and a voltage comparator. In this device, an internal temperature sensing circuit provides a threshold voltage which varies with ambient temperature. The analog ramp voltage at the junction 52 is compared to this threshold, and the comparator output is comparable to the waveform 36 in FIG. 3. The unit 54 is adapted to produce an on voltage when the threshold voltage exceeds the ramp voltage, and to revert to the off value when the ramp voltage exceeds the threshold voltage.

The output of the unit 54 is connected to a current amplifier 56 which may be, for example, a CMOS type 4049 circuit, to drive a power relay 58. The relay 58 connects an electrical power source 60 with a suitable ice reducing device 62.

Figure 5:
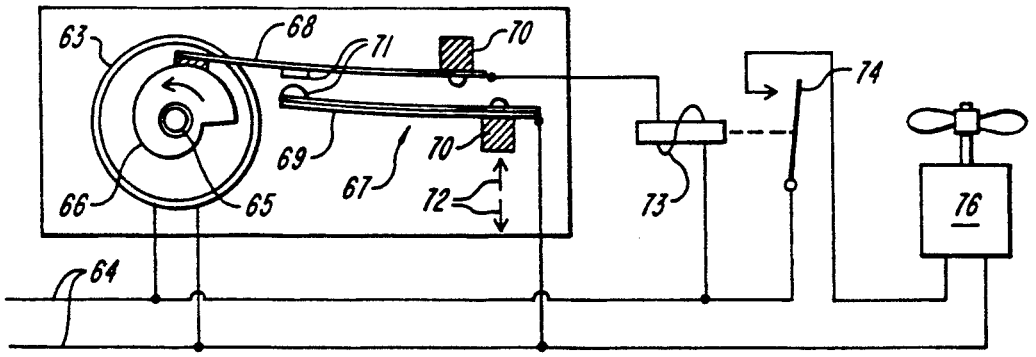
FIG. 5 illustrates a second embodiment employing mechanical elements.

FIG. 5 illustrates a second embodiment of the invention in which mechanical parts are employed. The timer comprises a synchronous or asynchronous clock motor 63 driven by a source 64 of electrical power. The speed of the motor 63 may be fixed or variable. The motor has a shaft 65 to which a cam 66 is fastened. The cam rotates at a speed of, for example, one revolution per hour, and corresponds in function to the ramp generator 18.

A thermostat 67, similar in structure to the type typically used in house heating controls, comprises a cam follower strip 68 bearing at one end on the cam 66, and a bimetallic strip 69. The strips 68 and 69 are fastened to fixed insulators 70 and carry mutually engaging contacts 71. The bimetallic strip 69 corresponds in function to the ambient condition transducer 22, moving up with falling air temperature and down with rising air temperature, and may be adjustable in the directions indicated by arrows 72 to control the 0° C. point of the thermostat. The strips 68 and 69 jointly control the opening and closing of the contacts 71 and jointly correspond in function to the comparator 32.

In freezing conditions, when the follower strip 68 falls to its lowest point the contacts 71 close to energize the coil 73 of a power relay, closing its contacts 74 to connect electrical power to a circulator 76. The contacts 71 open during each cycle of the cam 66 when the cam raises the follower strip 68 to a point where its contact ceases to bear on the strip 69, this point in turn being a function of the air temperature.

It will be evident from the embodiments of FIGS. 4 and 5 and the general description of FIGS. 1 to 3 that a suitable timing source may determine the period T in any of several ways. The period may be determined directly from the power frequency as in the embodiment of FIG. 4, or it may be determined by the speed of a synchronous or asynchronous motor as in the embodiment of FIG. 5. Alternatively, oscillating circuits of a conventional form may be employed. The period T may be constant or variable as a function of one or more ambient conditions, or may be varied by manual adjustment. It will also be evident from FIG. 4 that a single integrated circuit microprocessor can be assembled to perform the functions of the timer, the ramp generator, the ambient condition transducer and the comparator. In this case, the various characteristics such as ramp and ambient conditions will be in digital form rather than analog form. By this means a control of extremely small size and high reliability can be provided.

I claim:

1. A method for operating the power switch of a submerged energy transducer adapted to produce water movements to reduce surface ice formations, comprising the steps of sensing an ambient condition affecting ice formation and generating an ambient signal having a characteristic representing increases in amplitude with changes in said condition that increasingly produce ice formations, generating a ramp signal having a periodic characteristic representing progressively increasing amplitudes between a minimum value and a maximum value, comparing the amplitudes represented by the ramp and ambient signals, and changing the position of the power switch upon a change in the sign of the difference between said amplitudes.

2. A method according to claim 1, in which the ramp and ambient signals are varied in amplitude to form analog representations of the ramp and ambient characteristics.

3. A method according to claim 1, in which the ramp and ambient signals are digital representations of the respective amplitude values of the ramp and ambient signals.

4. A method according to claim 1, in which the frequency of the ramp signal is varied as a function of an ambient condition affecting ice formation.

5. A method according to claim 1, in which the maximum value of amplitude represented by the ramp signal is varied as a function of the size of the water surface area to be kept free of ice.

6. A method according to claim 1, in which said ambient condition is the air temperature.

7. Apparatus for reducing ice formation within a predetermined surface area of a body of water comprising, in combination, an energy transducer located and adapted to produce water movements beneath said area, a switch connecting the energy transducer with a source of energy, an ambient condition transducer sensing an ambient condition and having means to produce an ambient signal representing increases in amplitude with changes in said condition that increasingly produce ice formations, a timer generating a ramp signal having a periodic characteristic representing progressively increasing values of amplitude between a minimum value and a maximum value, a comparator for comparing the amplitudes represented by the ambient and ramp signals, and means actuated by the comparator to change the position of the switch upon a change in the sign of the difference between said amplitudes.

8. Apparatus according to claim 7, in which the timer and ambient condition transducer produce analog signals respectively representing the ramp and ambient signals.

9. Apparatus according to claim 7, in which the timer and ambient condition transducer produce digital representations of the respective amplitude values of the ramp and ambient signals.

10. Apparatus according to claim 7, in which the timer includes frequency reduction means for reducing an alternating power line frequency to a predetermined ramp frequency.

11. Apparatus according to claim 10, in which the frequency reduction means comprises a digital counter.

12. Apparatus according to claim 11, in which the timer comprises a second digital counter having stages each adapted for progressively varying the amplitude of a signal to produce an electrical analog of the ramp characteristic.

13. Apparatus according to claim 10, in which the frequency reduction means comprises a clock motor.

14. Apparatus according to claim 13, including a thermostat comprising a thermal transducer, electrical contacts actuated by the transducer at a thermal set point, and set selection means connected with the contacts and movable for varying the set point, and cam means rotated by the clock motor and adapted for displacing the set selection means to produce a mechanical analog of the ramp characteristic.

15. Apparatus according to claim 7, in which said ambient condition transducer is responsive to the air temperature.

16. Apparatus according to claim 7, in which said ambient condition transducer is responsive to the ambient air velocity.

17. Apparatus according to claim 7, in which said ambient condition transducer is responsive to the ambient air humidity.

18. Apparatus according to claim 7, in which said ambient condition transducer is responsive to the ambient water temperature.

19. Apparatus according to claim 7, in which said ambient condition transducer is responsive to the intensity of sunlight on the water surface adjacent said predetermined surface area.

20. Apparatus according to claim 7, in which said ambient condition transducer is responsive to wave action adjacent said predetermined surface area.

21. Apparatus according to claim 7, in which the timer includes an oscillator with a frequency divider to produce said ramp signal.

22. Apparatus according to claim 7, in which the frequency of the ramp signal is variable.

23. Apparatus according to claim 7, in which the ambient condition transducer is operatively connected to the timer to vary the frequency of the ramp signal as a function of the amplitude of said ambient condition.

24. Apparatus according to claim 7, including means to adjust the maximum value of the amplitude represented by the ramp signal as a function of the desired size of predetermined surface area.

* * * * *